US006877893B2

(12) United States Patent
Mock et al.

(10) Patent No.: US 6,877,893 B2
(45) Date of Patent: Apr. 12, 2005

(54) TIMEPIECE WITH MECHANICAL REGULATION

(76) Inventors: Elmar Mock, Lehmgrubenweg 20, 2504 Biel (CH); Bonny Witteveen, Orchideeweg 18, 5915 HP Vanlo (NL)

( * ) Notice: Subject to any disclaimer, the term of this patent is extended or adjusted under 35 U.S.C. 154(b) by 3 days.

(21) Appl. No.: 10/208,640

(22) Filed: Jul. 30, 2002

(65) Prior Publication Data

US 2003/0072220 A1 Apr. 17, 2003

Related U.S. Application Data

(63) Continuation-in-part of application No. 09/743,650, filed as application No. PCT/CH99/00321 on Jul. 14, 1999, now abandoned.

(30) Foreign Application Priority Data

Jul. 14, 1998 (CH) ..... 1498/98

(51) Int. Cl.[7] ..... G04B 15/00
(52) U.S. Cl. ..... 368/127; 368/124; 368/223
(58) Field of Search ..... 368/124–130, 368/223–249

(56) References Cited

U.S. PATENT DOCUMENTS 3,599,423 A * 8/1971 Beguin et al. ..... 368/171
3,910,028 A * 10/1975 Suard ..... 368/128
3,991,556 A * 11/1976 Renaud ..... 368/169
4,363,553 A * 12/1982 Thomi et al. ..... 368/140
4,500,213 A * 2/1985 Grimm ..... 368/208
5,226,023 A * 7/1993 Grimm ..... 368/223
5,608,694 A * 3/1997 Grimm et al. ..... 368/127

OTHER PUBLICATIONS

Denis Schnegg, "le chronométre tourbillon à échappement détente sous trois ponts d'or réédition 1982", Actes Du Xie Congrés International De Chronométrie, Oct. 4–6, 1984, pp. 147–151, XP002101229, Besançon, France.

* cited by examiner

*Primary Examiner*—Randy Gibson
*Assistant Examiner*—Michael L. Lindinger
(74) *Attorney, Agent, or Firm*—Pearne & Gordon LLP

(57) ABSTRACT

The invention concerns a timepiece comprising a mainspring with constant torque, having a balance spring and a balance wheel, the balance wheel (7) oscillation being maintained through an escapement mobile element (2) by moving a fixation point of the balance spring (6) when the oscillator passes through the oscillator impulse point, bringing about a circular motion of said balance spring (6) fixation point about the oscillator, thereby driving in rotation in time the mainspring-escapement assembly (2,6,7).

5 Claims, 9 Drawing Sheets

TIMEPIECE WITH MECHANICAL REGULATION

This application is a continuation in part of Ser. No. 09/743,650 filed Mar. 7, 2001 abandoned which is a 371 of PCT/CH99/00321 filed Jul. 14, 1999.

BACKGROUND OF THE INVENTION

The present invention describes a timepiece with mechanical regulation according to the definition of the claims. Such timepiece is especially adapted for use in wristwatches. It is of the type with balance wheel and balance spring with constant torque, wherein the oscillation is maintained through an escapement by the displacement of a fixation point of a balance spring when the oscillator passes through the oscillator impulse point.

The present invention is included in the family of the so-called "vortex" timepieces. The classic type of such a timepiece is represented by the "Breguet vortex" of 1795. In this device, a balance wheel, the balance spring and the escapement are mounted inside a rotating cage, the rotational velocity of the cage being of 60 sec per revolution. The whole cage rotates about a gearing.

SUMMARY OF THE INVENTION

One object of the present invention is the compensation of the defects in dynamic and static balancing of the mainspring-escapement assembly due to geometry or manufacturing problems, or the asymmetric beatings of the balance spring.

This object is achieved by the invention as defined by the claims.

The present invention relates to a timepiece of the type with balance wheel and balance spring with constant torque, wherein the oscillation is maintained through an escapement mobile element by the displacement of a fixation point of a balance spring when the oscillator passes through the oscillator impulse point. The fixation point moves in a circle about the axis of the oscillator, thus bringing about a rotation of the mainspring-escapement assembly. A substantial portion of the energy is transferred by the motion of the fixation point. An escapement anchor is directly supported on an escapement bridge.

In comparison to a timepiece with mechanical regulation of the traditional, so-called "vortex" type, with balance wheel and balance spring, the invention presents the following advantages.

The timepiece has a construction without rotating cage and without a pair of bearings, which allows a particularly simple and strong construction, thus requiring fewer elements.

- It allows a thin construction which is easy to obtain and particularly aesthetic. Contrary to a traditional "vortex" having a visible cage, a thin construction is difficult to realize.
- It brings about a reduction of the height, the mass and the momentum of the timepiece. This construction is adapted for big and small calibers.
- The rotation of the "vortex" about itself is faster (from 2 to 30 seconds per revolution).
- The output of the escapement is higher, allowing the use of a weaker barrel spring or the achievement of a larger working reserve.
- It brings about a reduction of all mechanical efforts and wear.

BRIEF DESCRIPTION OF THE SEVERAL VIEWS OF THE DRAWING

The invention will be described in further detail here below with reference to the following figures, among which.

DETAILED DESCRIPTION OF THE INVENTION

Figure 1:
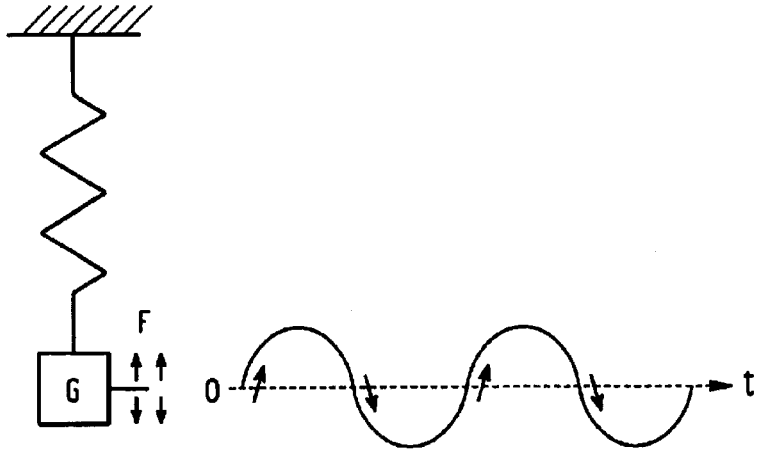
Fig. 1 PRIOR ART
FIG. 1 shows a diagram of a traditional timepiece with regulator.

FIG. 1 shows a diagram of a timepiece with regulator of the traditional type with balance wheel and balance spring. In such timepieces with regulator, the oscillation of the balance wheel is maintained through the escapement by a force couple F which is applied directly on the oscillator G when said oscillator passes at the impulse point. This transfer of a force couple to the balance wheel may be carried out either in an alternated manner or unidirectional, according to the type of escapement.

It should be noted that in order to reduce the disturbances on the oscillator, the duration of the impulse must be minimal. The quality factor of the oscillator is directly proportional to the frequency of said oscillator. It becomes more difficult to transfer a constant torque to the oscillator as the velocity at the impulse point increases. So, the output of the escapement can vary for example between 20 and 50%. Furthermore, every variation in the driving couple on the escapement is transferred directly to the oscillator and may influence the amplitude of the oscillation. The defects in the dynamic and static balancing of the mainspring-escapement assembly due to geometry or manufacturing problems, or the asymmetric beating of the balance spring are not compensated. For all these reasons, particular care is therefore necessary during the manufacture and assembly of the components of the time regulator in order to guarantee the reliability thereof.

Figure 2:
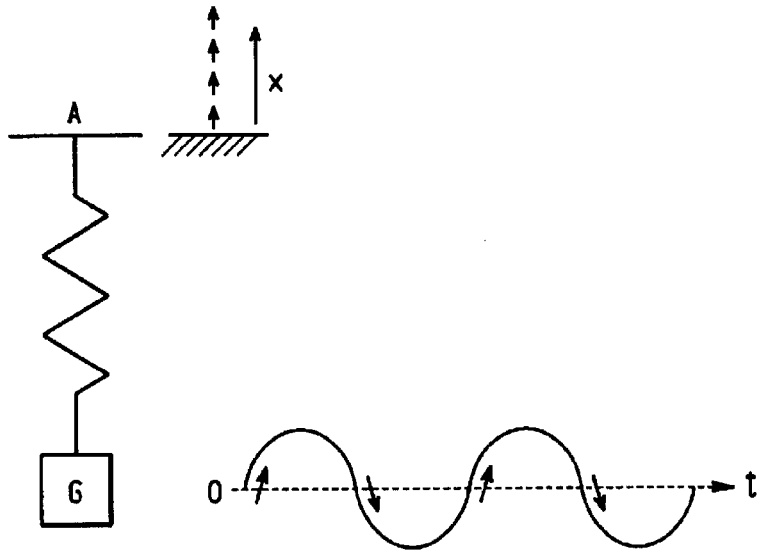
FIG. 2 shows a diagram of an example of a timepiece with regulator according to the invention with displacement in two directions of the resultant escapement mobile element, in an asymmetric energy transfer to the oscillator.
Figure 3:
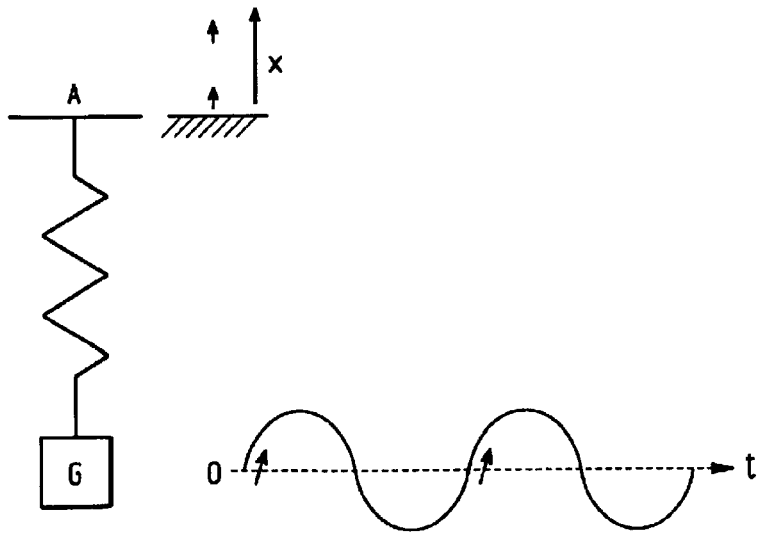
FIG. 3 shows a diagram of another example of a timepiece with regulator according to the invention with displacement in one single direction of the resultant escapement mobile element, in a symmetrical energy transfer to the oscillator.

The invention is characterized in that an energy transfer for maintaining the oscillation of the balance wheel is achieved by means of a displacement X of the fixation point A of the spring. This displacement of the fixation point A of the spring occurs when the oscillator passes through the oscillator impulse point G. FIGS. 2 and 3 show a diagram of a timepiece with regulator according to the invention, with a displacement of the escapement mobile element in two directions when the oscillator, passes at the oscillator impulse point (FIG. 2) and with a displacement of the escapement mobile element in one direction when the oscillator passes at the oscillator impulse point (FIG. 3).

In order to bring about a displacement of the escapement mobile element in two directions, the oscillator receives an impulse, for example every time the oscillator passes at the oscillator impulse point, or once every half-period, according to FIG. 2. FIG. 2 shows an interval of two periods of the motion of the oscillator, during which it receives four impulses which are represented by four arrows. The oscillator receives an impulse when it approaches and it receives an impulse when it moves away from the impulse point. Taking account of the mass of the oscillator, this energy transfer shown in FIG. 2 is asymmetric.

In order to bring about a displacement of the escapement mobile element in one single direction, the oscillator receives an impulse for example during every second passage at the impulse point or once every period, according to FIG. 3. FIG. 3 shows an interval of two periods of the motion of the oscillator, during which it receives two impulses, represented by two arrows. The oscillator receives an impulse when it approaches or when it moves away from the oscillator impulse point. Taking account of the mass of the oscillator, this energy transfer shown in FIG. 3 is symmetrical. It is of course possible, without leaving of the scope of the invention, to choose other intervals for transferring an impulse to the oscillator. It is for example possible to transfer a first impulse to the oscillator every second passage at the oscillator impulse point and to transfer a following impulse during a third passage at the oscillator impulse point, and so forth. So it is possible to vary the number of displacements of the escapement mobile element during each interval.

The position of the oscillator impulse point may lie on any point on the sinus curves. According to the exemplary embodiment of FIG. 3, the impulse point corresponds to the points of inflection or points 0 of the sinus curves, where the oscillator has a maximum velocity. The velocity of the oscillator at the points of inflection on the sinus curve being relatively high, the detection of the oscillator (through the use a driving ankle, see the following description) and the displacement of the fixation point must be carried out rapidly. The output of the escapement is relatively weak (of the order of 20%). The oscillator is able to receive an impulse in both directions, either the direction along which it approaches or the direction along which it moves away from a point of inflection. The disturbances on the oscillator when energy is transferred to the oscillator at the points of inflection are minimal.

It is quite possible to assign any other point on the sinus curves as oscillator impulse points. So it is for example possible that the impulse point corresponds to the maxima of the sinus curves, where the oscillator has a minimal velocity. The velocity of the oscillator at the maxima of the sinus curve being low, the detection of the oscillator and the displacement of the fixation point do not have to be carried out rapidly. The disturbances on the oscillator when energy is so transferred to the oscillator at the maxima of the sinus curves is minimum. The detection of the oscillator is easy to achieve. The output of the escapement is very high (about 50%). It is also possible that the impulse point corresponds to a point close to the maxima of the sinus curves, where the oscillator already or still has a low velocity. The output when energy is transferred to the oscillator at a point which is close to the maxima of the sinus curve is still very high. The velocity of the oscillator at the maxima of the sinus curve being low, the detection of the oscillator and the displacement of the fixation point do not have to be carried out rapidly, and the disturbances on the oscillator are minimal.

The energy is transferred by the motion of the fixation point and by a motion of the escapement anchor. The distribution of this transfer is substantially a function of the rotational angle of the fixation point. A first portion of the energy (which varies between 10 and 100%) is transferred by the motion of the fixation point through giving an impulse to the oscillator. A second portion of the energy (which varies between 0 and 90%) is transferred by the motion of the escapement anchor through giving an impulse to a driving ankle (see the description below). It is thus possible either to create a "pure" embodiment transferring 100% of the energy by the motion of the fixation point, or to create some "mixed" embodiments transferring between 10 and 100% of the energy by the motion of the fixation point and between 0 and 90% of the energy by the motion of the escapement anchor.

The variations of the driving couple at the escapement are not transferred to the oscillator and therefore do not influence the amplitude of the oscillation. The defects in the dynamic and static balancing of the mainspring-escapement assembly due to geometry or manufacturing problems, or the asymmetric beating of the balance spring are compensated (by the vortex principle). For all these reasons, the care exerted during the manufacture and the assembly of the components of the time regulator has only a limited influence on a guaranteed reliability thereof.

The energy transfer is carried out by means of displacing the fixation point of the balance spring. This X displacement induces a potential energy in the balance spring, which in turn will maintain the oscillation of the balance wheel. This maintenance energy is a function of a number of parameters. It depends in particular on dynamic and geometric features of the balance wheel and the balance spring, the angular value of the displacement of the balance spring fixation point, the application point in the oscillation cycle of said displacement, and the time which is necessary for said fixation point to carry out the displacement.

It should be noted that a driving couple is applied on the fixation point in order to bring about a displacement lying above a minimum value of the displacement of said fixation point. The influence of the variations of said driving couple on the maintenance energy may be deemed as negligible. For this reason, the maintenance of the oscillation of this regulator is obtained with a constant torque.

Figure 4:
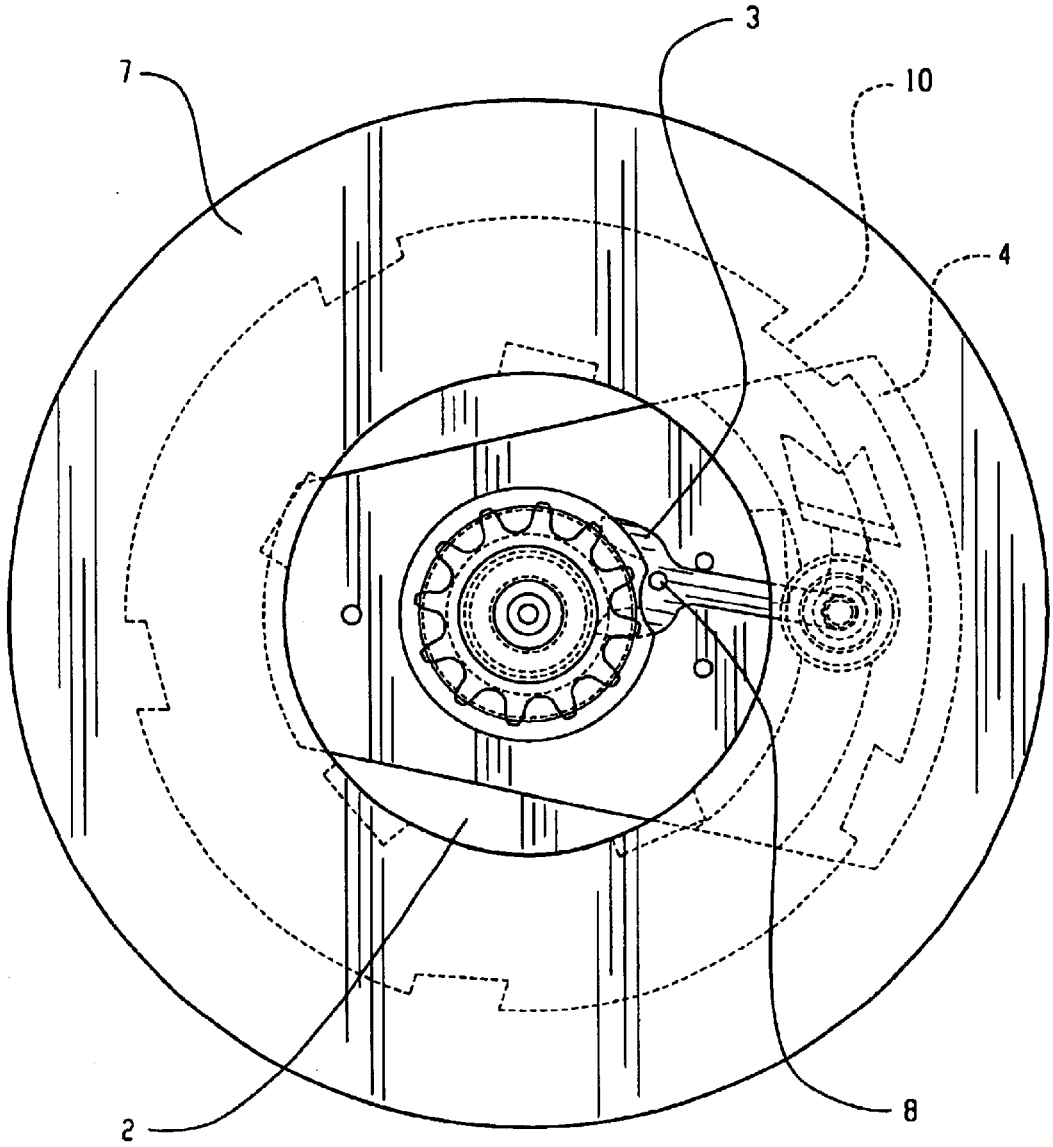
FIG. 4 shows a top view of an exemplary embodiment of a timepiece with regulator according to the invention.
Figure 5:
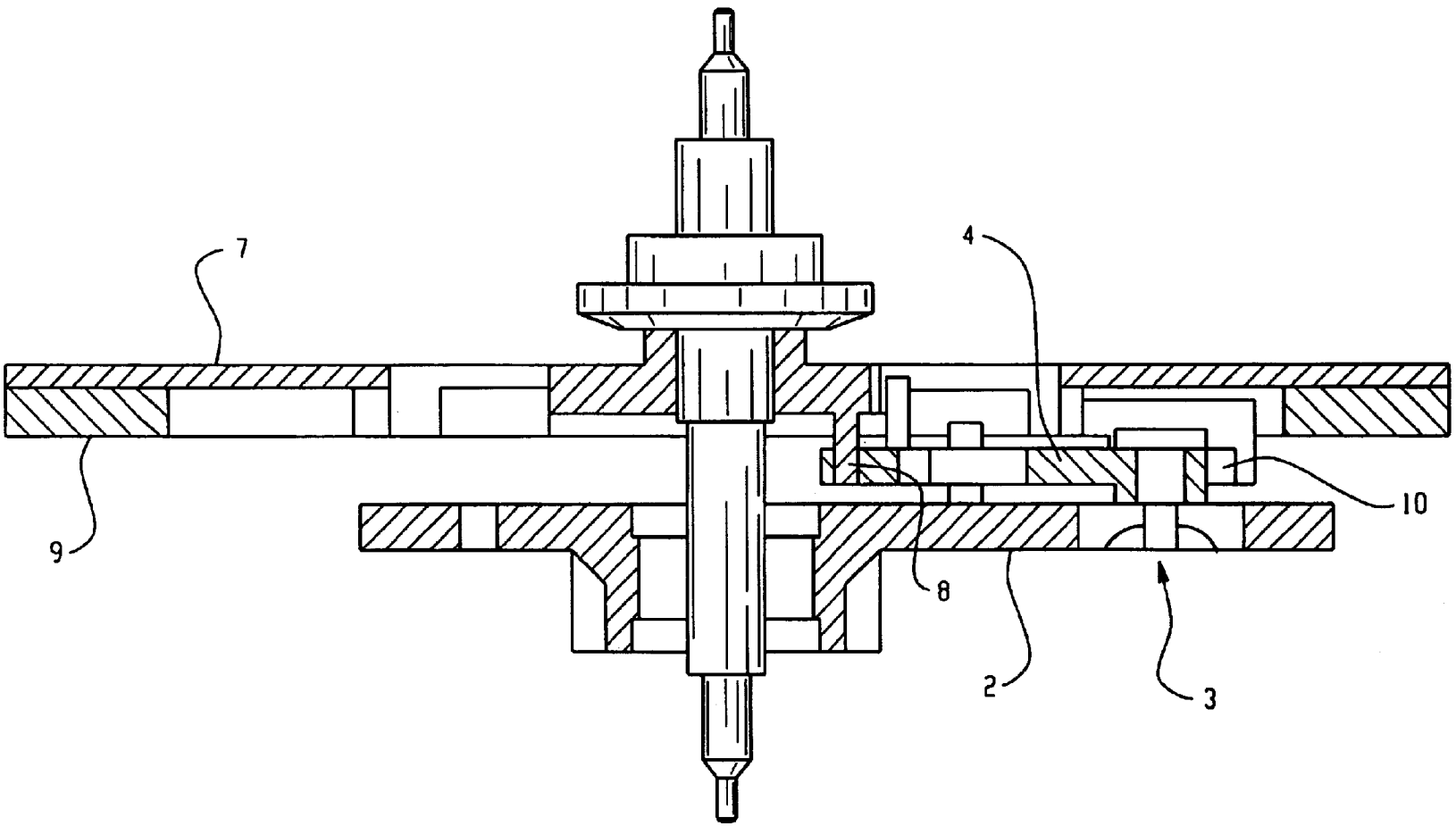
FIG. 5 shows a side sectional view of an exemplary embodiment of a timepiece with regulator according to FIG. 4.
Figure 6:
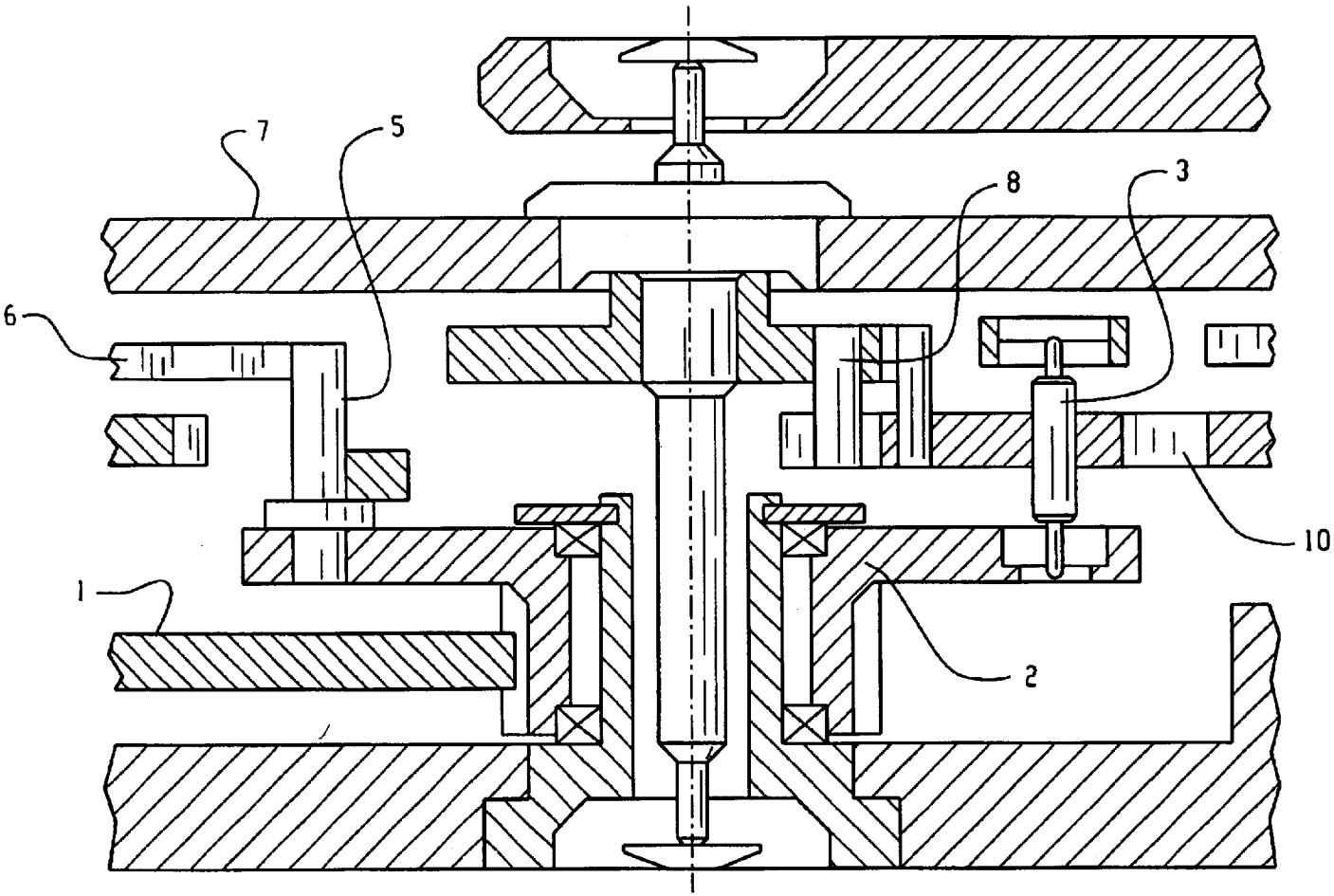
FIG. 6 shows a side sectional view of an enlarged detail of an exemplary embodiment of a timepiece with regulator according to FIG. 4 and FIG. 5.

FIGS. 4 to 6 show different views of a detail of a exemplary embodiment of a timepiece with regulator according to the invention. FIG. 4 shows a top sectional view, FIG. 5 shows a side sectional view and FIG. 6 shows a side sectional view of an enlarged detail.

According to this embodiment, an intermediate wheel 1 is provided for transferring a driving couple from a barrel spring to an escapement mobile element 2. An escapement bridge 4 is able to function as a bearing for said intermediate wheel 1. The escapement bridge 4 has an escapement gearing 10 having a special shape which is hollow and concentric to a balance wheel 7, and acting as a support and limitation of a rotation of the escapement mobile element 2.

A first end of this balance spring 6 is fixed by a fixation pin to 5 the escapement mobile element 2. Another end of this balance spring 6 is fixed to the balance wheel 7 at a point 11.

The escapement mobile element 2 has a bearing arranged concentrically to the balance wheel 7. This escapement mobile element 2 drives jointly an escapement anchor 3 and the fixation pin 5 of the spring balance spring 6. The escapement anchor 3 is able to pivot about the axis thereof, allowing a rotation of the escapement mobile element 2 only in one single direction. Preferably, the escapement anchor 3 pivots to find its way through the teeth of the escapement bridge 4. The escapement anchor 3 is arranged for example at the bottom, to pass below the teeth of the escapement bridge 4. The gearing of escapement 10 of the escapement bridge 4 acts as a supporting point for the escapement anchor 3 and limits the rotational angle of the escapement mobile element 2 through the escapement anchor 3. The escapement anchor 3 is supported on the escapement bridge 4 and sets free the rotary motion of the escapement mobile element 2 directly.

The fixation pin 5 of the balance spring 6 being fixedly attached to the escapement mobile element 2, it transfers to the balance spring 6 the angular motion it has just received, while storing in the balance spring 6 an amount of potential energy which in turn will initiate the oscillation of the balance wheel 7.

A pin 8 driving the escapement anchor 3 is fixedly attached on a plate of the axis of the balance wheel 7. This pin 8 is positioned so that it initiates the pivoting of the escapement anchor 3 when the balance wheel 7 passes at the impulse point of the oscillation. Said pivoting of the escapement anchor 3 sets free the supporting point on said escapement gearing 10 of the escapement anchor 3 and allows an angular rotation of the escapement mobile element 2 which is limited by a next supporting point of the escapement anchor 3 on the escapement gearing 10. The fixation pin 5 of the balance spring 6 being fixedly attached to the escapement mobile element 2, said fixation pin 5 transfers to the balance spring 6 the angular motion it has just received, storing in the balance spring 6 an amount of potential energy which will maintain the oscillation of the balance wheel 7. The frequency of oscillation of the balance wheel can be adjusted by displacing at least one adjustment mass 9 being arranged for example in an oval shaped recess which is machined in the balance wheel 7. This displacement changes the moment of inertia of the balance wheel—adjustment mass assembly and therefore the frequency of oscillation. The rotational velocity of the mainspring-escapement assembly 2, 6, 7 is very fast and is comprised between 2 and 30 seconds per revolution. The skilled person in the art, knowing the present invention, will of course be able to realize other mainspring-escapement assemblies having higher rotational velocities, comprised for example between 1 and 2 seconds per revolution, or lower rotational velocities, comprised for example between 30 and 60 seconds per revolution.

The value of the rotational angle of the escapement mobile element 2 is a function of the direction of passage of the driving pin 8 of the escapement anchor 3, the geometry of the escapement anchor 3, the escapement gearing 10 and the angle of freedom of the escapement anchor 3 on the escapement mobile element 2. The rotational angle can be varied according to the direction of passage of the balance wheel 7 when energy is transferred at the passage at the impulse point, allowing a symmetric or asymmetric energy transfer, and can be varied according to the number of displacements of the escapement mobile element 2 for each interval of the oscillation of the balance wheel.

Figure 7:
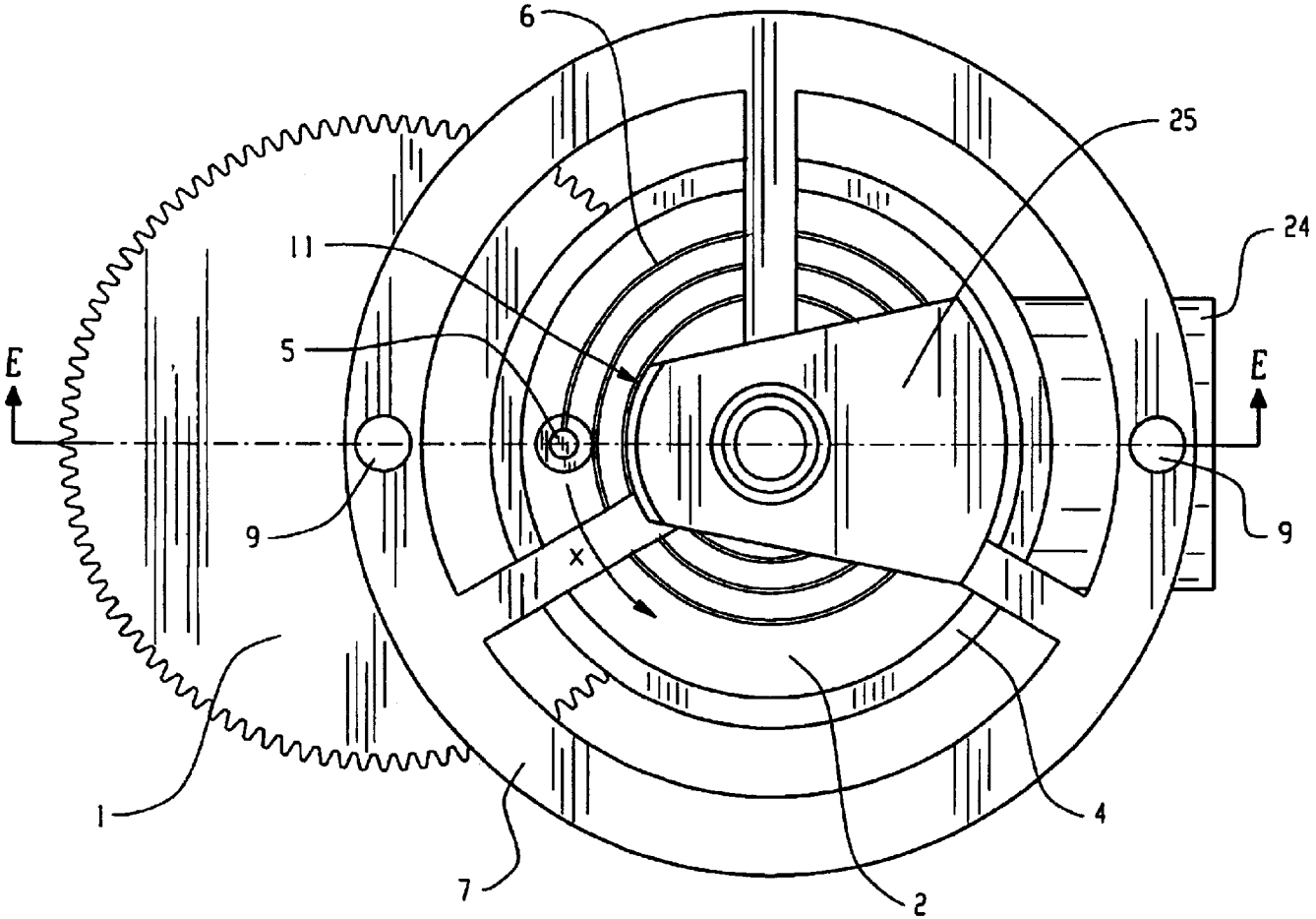
FIG. 7 shows a top view of the timepiece according to FIGS. 4 to 6.
Figure 8:
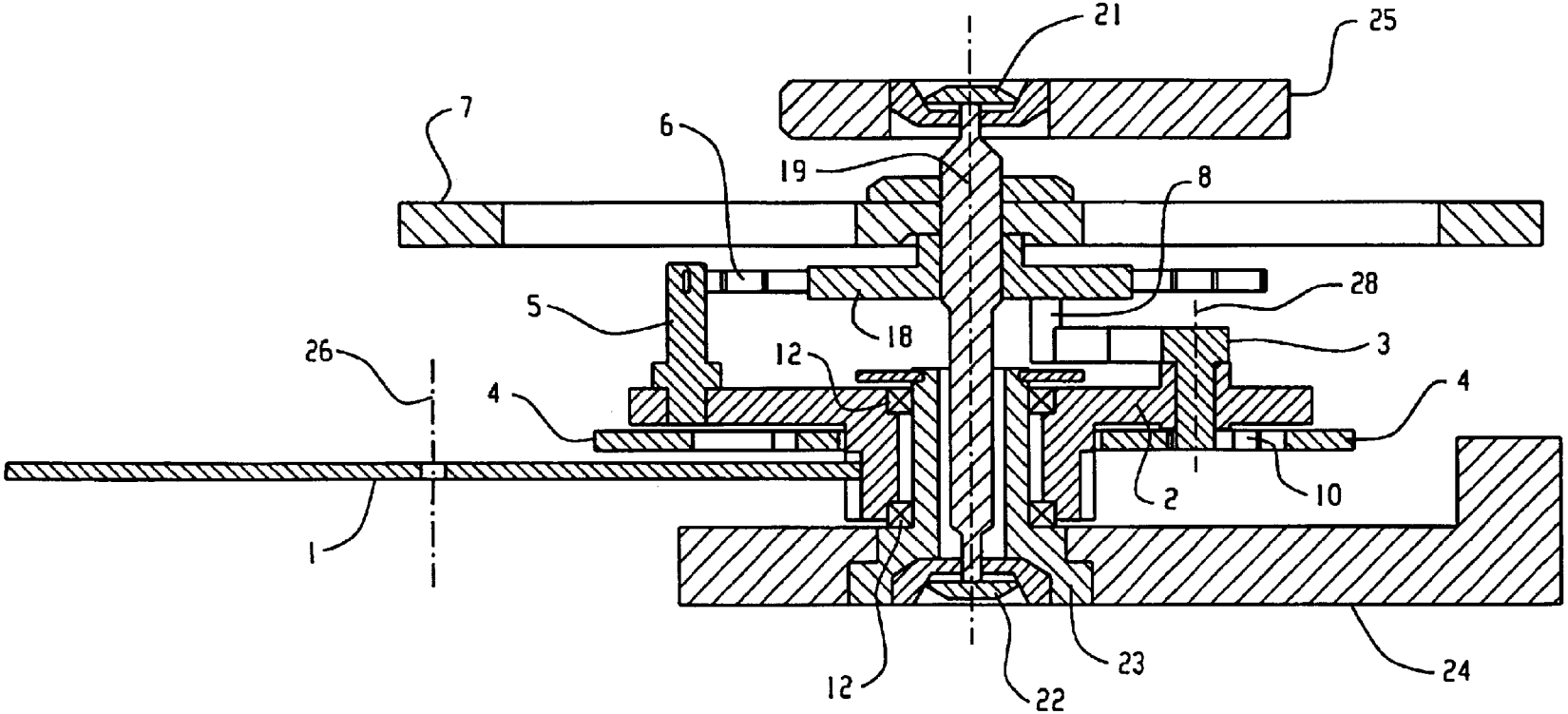
FIG. 8 shows a section view along line EE of the timepiece of FIG. 7.
Figure 9:
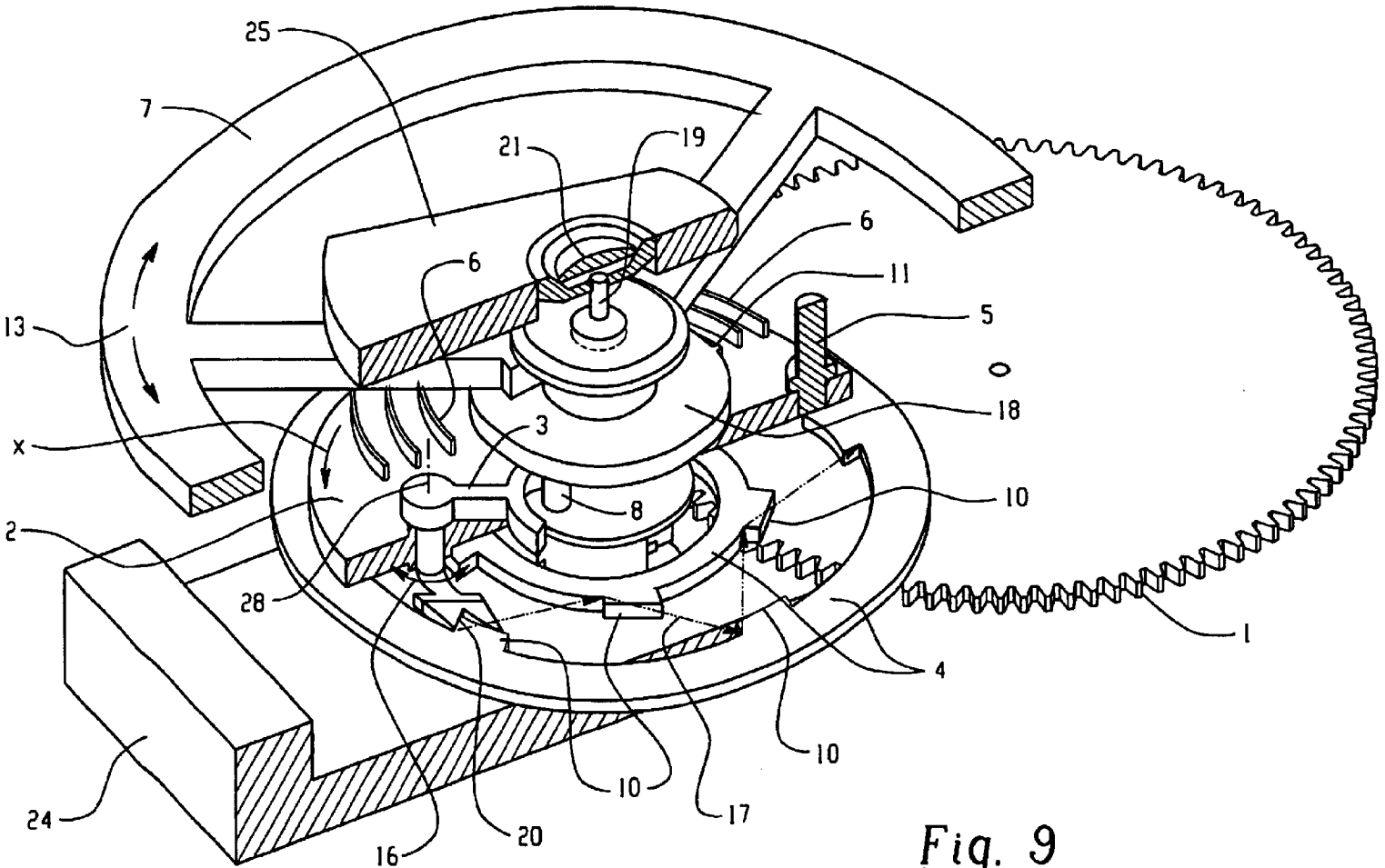
FIG. 9 shows a perspective view of the embodiment according to FIGS. 4 to 8.
Figure 10:
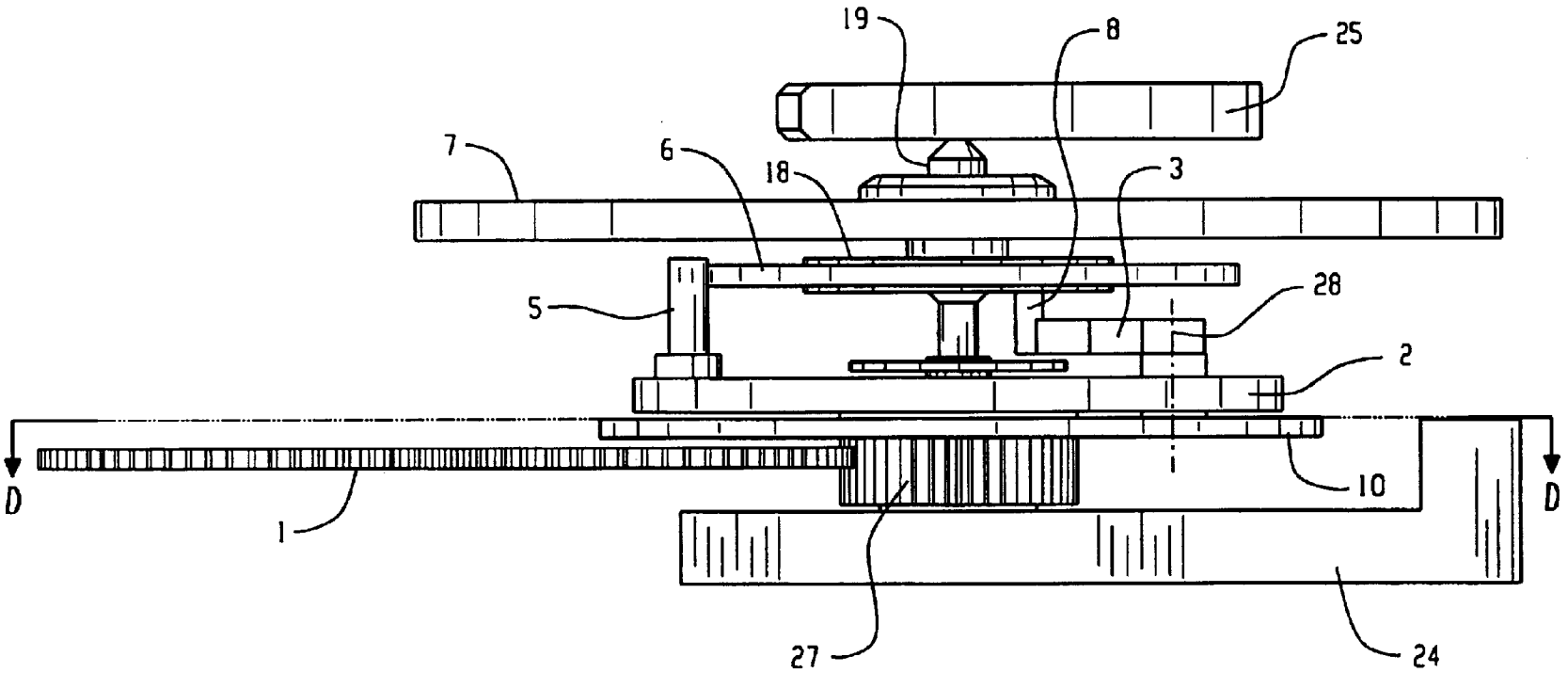
FIG. 10 shows a side view of the embodiment according to FIGS. 4 to 9.
Figure 11:
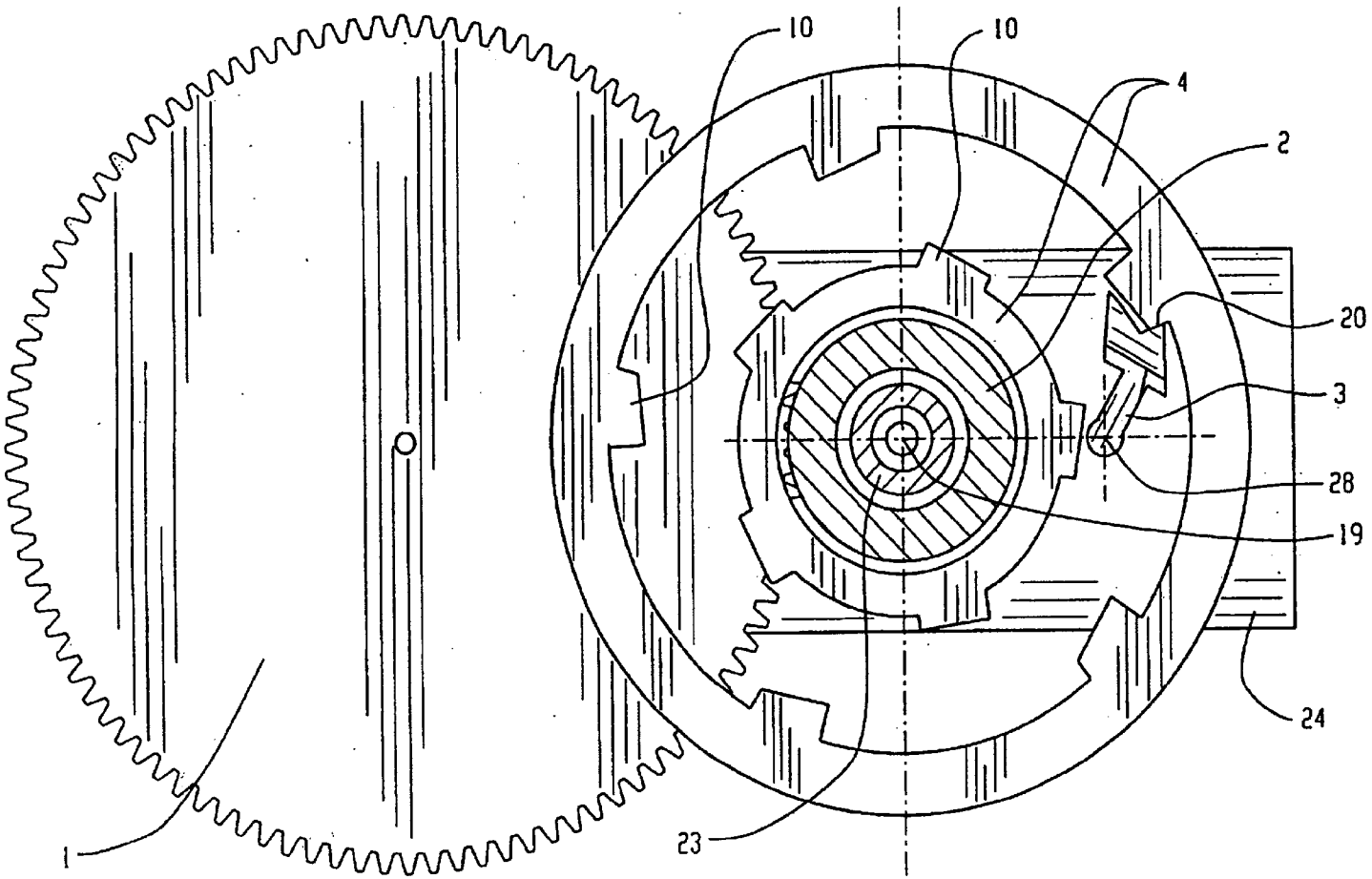
FIG. 11 shows a section view along line DD of the embodiment according to FIG. 10.

FIGS. 7 to 11 are showing more detailed the timepiece according to FIGS. 4 to 6. The section view of FIG. 8 corresponds to the section views shown in FIGS. 5 and 6. FIG. 7 shows a top view, FIG. 8 shows a side sectional view through FIG. 7 along line EE. FIG. 9 show the timepiece in a perspective view. Certain parts are shown in a sectional presentation An intermediate wheel 1, which turns on an intermediate wheel axis 26, is provided for transferring a driving couple from a barrel spring (not visible in detail) to a toothed wheel 27 of an escapement mobile element 2. The escapement bridge 4 has an escapement gearing 10 (see FIG. 11) having a special shape which is hollow and concentric to a balance wheel 7, and acting as a support and limitation of a rotation of the escapement mobile element 2. As shown in FIGS. 4 and 11 the teeth 10 of the escapement bridge 4 are arranged alternatively on two concentric circles.

A first end of this balance spring 6 is fixed by a fixation pin to 5 the escapement mobile element 2. Another end of this balance spring 6 is fixed to the balance wheel 7 at a point 11 (see FIG. 9).

The balance wheel 7 is arranged to turn on a balance wheel axle 19 which is held by an upper and a lower bearing 21, 22. The escapement mobile element 2 has a bearing 12 (see FIG. 8) arranged concentrically to the balance wheel 7 to turn about the balance wheel axis. This bearing 12 is mounted on a tubular fixation element 23 which is fixed a base 24 of the timepiece. The lower bearing 22 of the axle 19 of the balance wheel 7 is mounted on the inside of the coaxial to the tubular fixation element 23. The upper bearing 21 of the axle 19 of the balance wheel 7 is hold by an upper bridge 25 which is fixed to the base 24.

The escapement mobile element 2 drives jointly an escapement anchor 3 and the fixation pin 5 of the spring balance spring 6. The escapement anchor 3 is able to pivot about a second axis 28, allowing a rotation of the escapement mobile element 2 only in one single direction X. Preferably, the escapement anchor 3 pivots (arrow 16) to find its way (arrows 17) through the teeth 10 of the escapement bridge 4. The escapement anchor 3 is arranged for example at the bottom, to pass below the teeth of the escapement bridge 4. The gearing of escapement 10 of the escapement bridge 4 acts as a supporting point for the escapement anchor 3 and limits the rotational angle of the escapement mobile element 2 through the escapement anchor 3. The escapement anchor 3 is supported on the escapement bridge 4 and sets free the rotary motion of the escapement mobile element 2 directly.

The fixation pin 5 of the balance spring 6 being fixedly attached to the escapement mobile element 2, it transfers to the balance spring 6 the angular motion it has just received, while storing in the balance spring 6 an amount of potential energy which in turn will initiate the oscillation of the balance wheel 7.

A driving pin 8 driving the escapement anchor 3 is fixedly attached on a plate 18 of the axle 19 of the balance wheel 7. This pin 8 is positioned so that it initiates the pivoting of the escapement anchor 3 when the balance wheel 7 passes at the impulse point of the oscillation. Said pivoting of the escapement anchor 3 sets free the supporting point 20 on said escapement gearing 10 of the escapement anchor 3 and allows an angular rotation of the escapement mobile element 2 which is limited by a next supporting point of the escapement anchor 3 on the escapement gearing 10. The fixation pin 5 of the balance spring 6 being fixedly attached to the escapement mobile element 2, said fixation pin 5 transfers to the balance spring 6 the angular motion it has just received, storing in the balance spring 6 an amount of potential energy which will maintain the oscillation of the balance wheel 7. The frequency of oscillation of the balance wheel can be adjusted by displacing at least one adjustment mass 9 being arranged for example in an oval shaped recess (not visible) which is machined in the balance wheel 7. This displacement changes the moment of inertia of the balance wheel—adjustment mass assembly and therefore the frequency of oscillation. The rotational velocity of the mainspring-escapement assembly 2, 6, 7 is very fast and is comprised between 2 and 30 seconds per revolution. The skilled person in the art, knowing the present invention, will of course be able to realize other mainspring-escapement assemblies having higher rotational velocities, comprised for example between 1 and 2 seconds per revolution, or lower rotational velocities, comprised for example between 30 and 60 seconds per revolution.

The value of the rotational angle of the escapement mobile element 2 is a function of the direction of passage of the driving pin 8 of the escapement anchor 3, the geometry of the escapement anchor 3, the escapement gearing 10 and the angle of freedom of the escapement anchor 3 on the escapement mobile element 2. The rotational angle can be varied according to the direction of passage of the balance wheel 7 when energy is transferred at the passage at the impulse point, allowing a symmetric or asymmetric energy transfer, and can be varied according to the number of displacements of the escapement mobile element 2 for each interval of the oscillation of the balance wheel.

What is claimed is:

1. Timepiece comprising a balance wheel being arranged to turn oscillating around a balance wheel axis and an escapement mobile element, being arranged to turn around the balance wheel axis in one direction, and a balance spring, which is connected to said escapement mobile element and to said balance wheel, further comprising an escapement anchor being arranged on said escapement mobile element to pivot around a second axis, said escapement anchor engaging with teeth of an escapement bridge, and a driving pin connected to the balance wheel, said driving pin arranged to initiate the pivoting of the escapement anchor when the balance wheel passes at a impulse point of the oscillation, setting free the supporting point of the escapement anchor on said teeth of the escapement bridge.

2. Timepiece according to claim 1, wherein the teeth of the escapement bridge are arranged alternatively on two concentric circles.

3. Timepiece according to claim 1, wherein the balance wheel is hold by an upper and a lower bearing.

4. Timepiece according to claim 1, comprising at least one adjustment mass being arranged on said balance wheel, said adjustment mass being arranged displaceable to change the moment of inertia.

5. Procedure to set a balance wheel into an oscillating motion about a balance wheel axis comprising the following steps:

a) supplying a driving couple to an escapement mobile element arranged rotatable about the balance wheel axis;

b) setting the balance wheel into an initial movement around the balance wheel axis;

c) initiating an angular rotation of an escapement mobile element by setting free the supporting point of an escapement anchor on an escapement gearing by a driving pin connected to the balance wheel;

d) displacing a first end of a balance spring which is connected to the escapement mobile and the balance spring by a certain circular movement in a direction X about the balance wheel axis until the escapement anchor is engaged by a next teeth, such that an amount of potential energy is stored in the balance spring;

e) repeating the steps c and d.

* * * * *

UNITED STATES PATENT AND TRADEMARK OFFICE

CERTIFICATE OF CORRECTION

PATENT NO. : 6,877,893 B2
DATED : April 12, 2005
INVENTOR(S) : Elmar Mock et al.

It is certified that error appears in the above-identified patent and that said Letters Patent is hereby corrected as shown below:

Title page,
Item [76], Inventors, delete "Vanlo" insert -- Venlo --.
Item [63], Related U.S. Application Data, delete "Continuation-in-part of application No. 09/743,650, filed as application No. PCT/CH99/00321 on Jul. 14, 1999, now abandoned.", insert -- Continuation-in-part of application No. 09/743,650 filed March 7, 2001, now abandoned, which is a 371 of PCT/CH99/00321 filed July 14, 1999. --.

Column 3,
Line 6, delete "oscillator,", insert -- oscillator --.

Signed and Sealed this

Twentieth Day of December, 2005

JON W. DUDAS
*Director of the United States Patent and Trademark Office*